US007841840B2

(12) United States Patent
Sato et al.

(10) Patent No.: US 7,841,840 B2
(45) Date of Patent: Nov. 30, 2010

(54) DOUBLE-HEADED PISTON TYPE COMPRESSOR

(75) Inventors: Shinichi Sato, Kariya (JP); Masahiro Kawaguchi, Kariya (JP); Jun Kondo, Kariya (JP); Takeshi Aoki, Kariya (JP); Tomohiro Wakita, Kariya (JP); Mitsuyo Ishikawa, Kariya (JP); Akio Saiki, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 256 days.

(21) Appl. No.: 11/922,428

(22) PCT Filed: Oct. 17, 2006

(86) PCT No.: PCT/JP2006/320612

§ 371 (c)(1),
(2), (4) Date: Dec. 17, 2007

(87) PCT Pub. No.: WO2007/046351

PCT Pub. Date: Apr. 26, 2007

(65) Prior Publication Data

US 2009/0238697 A1 Sep. 24, 2009

(30) Foreign Application Priority Data

Oct. 17, 2005 (JP) ..... 2005-302354
Oct. 16, 2006 (JP) ..... 2006-281667

(51) Int. Cl.
*F04B 1/16* (2006.01)

(52) U.S. Cl. ..... 417/269; 92/12.2

(58) Field of Classification Search ..... 417/269, 417/298; 92/12.2
See application file for complete search history.

(56) References Cited

U.S. PATENT DOCUMENTS 5,032,060 A * 7/1991 Kobayashi et al. ..... 417/222.1
5,362,208 A 11/1994 Inagaki et al.

(Continued)

FOREIGN PATENT DOCUMENTS

JP 5-195949 8/1993

(Continued)

OTHER PUBLICATIONS

English translation of the International Preliminary Report on Patentability dated May 2, 2008, Application No. PCT/JP2006/320612.

(Continued)

*Primary Examiner*—Devon C Kramer
*Assistant Examiner*—Leonard J Weinstein
(74) *Attorney, Agent, or Firm*—Locke Lord Bissell & Liddell LLP

(57) ABSTRACT

A mechanism for drawing in refrigerant to front compression chambers (28*a*) of a double-headed piston type compressor differs from a mechanism for drawing in refrigerant to rear compression chambers (29*a*). More specifically, the mechanism for drawing in refrigerant to the front compression chambers (28*a*) include suction valves (18*a*) configured by flap valves. The mechanism for drawing in refrigerant to the rear compression chambers (29*a*) is configured by a rotary valve (35). Thus, pulsation of the compressor is reduced, so that the generation of noise is suppressed. As a result, a quiet compressor is achieved.

6 Claims, 6 Drawing Sheets

U.S. PATENT DOCUMENTS

| | | | | |
|---|---|---|---|---|
| 5,401,144 | A | 3/1995 | Fujii et al. | |
| 5,478,212 | A | 12/1995 | Sakai et al. | |
| 6,364,629 | B1 * | 4/2002 | Shintoku et al. | 417/269 |
| 2003/0095873 | A1 * | 5/2003 | Tarutani et al. | 417/222.1 |
| 2004/0197202 | A1 * | 10/2004 | Saiki et al. | 417/269 |

FOREIGN PATENT DOCUMENTS

| | | |
|---|---|---|
| JP | 5-312145 | 11/1993 |
| JP | 5-312146 | 11/1993 |
| JP | 2004-225557 | 8/2004 |

OTHER PUBLICATIONS

PCT International Search Report (PCT/2006/320612) mailed Jan. 9, 2007.

* cited by examiner

DOUBLE-HEADED PISTON TYPE COMPRESSOR

FIELD OF THE INVENTION

The present invention relates to a double-headed piston type compressor.

BACKGROUND OF THE INVENTION

As a compressor for a vehicle air conditioning system, a double-headed piston type compressor as disclosed in, for example, Patent Document 1 has been proposed. The cylinder block of this type of compressor includes cylinder bores for accommodating double-headed pistons. A swash plate, which operates together with a rotary shaft, causes the double-headed pistons to reciprocate in the cylinder bores. The double-headed piston type compressor includes compression chambers defined in each cylinder bore on both ends of the associated double-headed piston. Each double-headed piston compresses refrigerant drawn into the associated compression chambers, and discharges the compressed refrigerant to the outside of the compression chambers. Patent Document 1 discloses a compressor in which rotary valves are employed as a mechanism for drawing in refrigerant into the compression chambers, and a compressor in which suction valves are employed as a mechanism for drawing refrigerant into the compression chambers.

In these days, engines are made quieter to reduce noise in compartments of vehicles (in particular, automobiles). Thus, there is a demand for quieter compressors used in vehicle air conditioning systems. However, in the conventional compressor disclosed in Patent Document 1, noise and vibration are generated due to pulsation (pressure fluctuation) caused in the compressor. These noise and vibration are transmitted from the compressor to the passenger compartment through conduits, thereby generating noise in the passenger compartment. Thus, in the conventional compressor, sufficient measures are hardly taken to reduce noise to a desired level.

[Patent Document 1] Japanese Laid-Open Patent Publication No. 5-312146

SUMMARY OF THE INVENTION

Accordingly, it is an objective of the present invention to provide a quiet double-headed piston type compressor that has a reduced pulsation thereby suppressing noise.

The present invention provides a double-headed piston type compressor including a front housing member, a rear housing member, and a cylinder block located between the front housing member and the rear housing member. The cylinder block includes cylinder bores. The front housing member, the rear housing member, and the cylinder block define a swash plate chamber. The compressor defines a suction pressure zone. Each of double-headed pistons is slidably inserted in one of the cylinder bores. Each double-headed piston defines a compression chamber close to the front housing member and a compression chamber close to the rear housing member. One of the compression chambers serves as a first compression chamber and the other one of the compression chambers serves as a second compression chamber. The compressor includes a rotary shaft rotatably supported in the cylinder block and a swash plate, which rotates with the rotary shaft in the swash plate chamber. The swash plate causes the double-headed pistons to reciprocate in the cylinder bores. As a result, refrigerant is drawn into the compression chambers from the suction pressure zone and is compressed in and discharged from the compression chambers. A mechanism for drawing in the refrigerant to the first compression chambers is configured by a rotary valve, which includes an introduction passage for introducing the refrigerant from the suction pressure zone to the first compression chambers. A mechanism for drawing the refrigerant into the second compression chambers is configured by suction valves, which selectively open and close in accordance with the difference between the pressure in the suction pressure zone and the pressure in the second compression chambers.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

Figure 1:
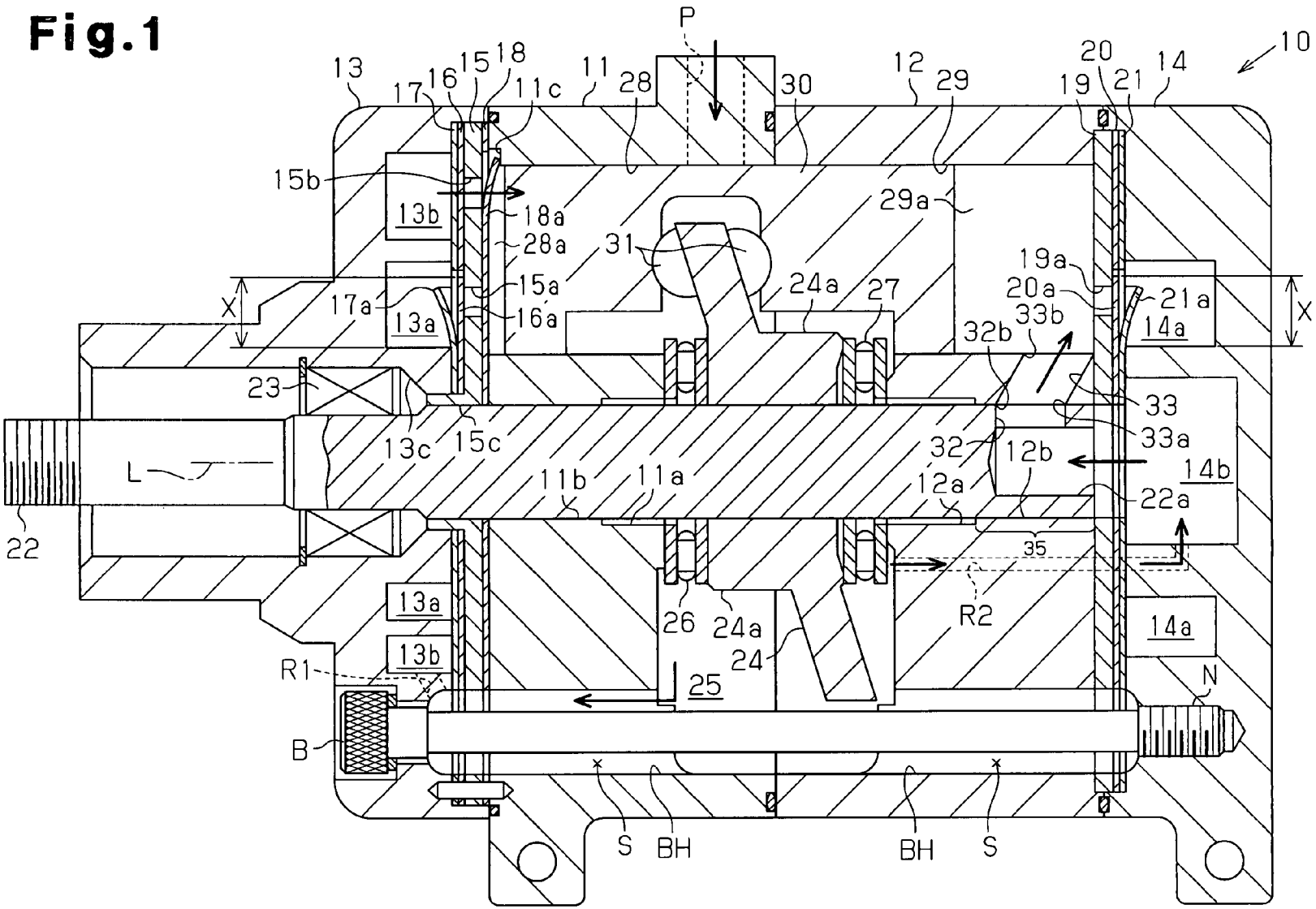
FIG. 1 is a cross-sectional view illustrating a double-headed piston type compressor according to a first embodiment of the present invention.

A first embodiment of the present invention will now be described with reference to FIGS. 1 and 2. FIG. 1 shows a cross-sectional view of a double-headed piston type compressor (hereinafter, simply referred to as a compressor) 10 according to a first embodiment. In FIG. 1 and FIGS. 4 to 7, the left end of the compressor 10 is defined as the front end, and the right end of the compressor 10 is defined as the rear end.

As shown in FIG. 1, a housing assembly of the compressor 10 includes a front (left in FIG. 1) cylinder block 11, a front housing member 13, which is secured to the front cylinder block 11, a rear (right in FIG. 1) cylinder block 12, and a rear housing member 14, which is secured to the rear cylinder block 12. The cylinder blocks 11, 12 are secured to each other. The cylinder blocks 11, 12, the front housing member 13, and the rear housing member 14 are tightened together by bolts (for example, five bolts) B. FIG. 1 shows only one of bolt insertion holes BH and one of the bolts B inserted in the bolt insertion hole BH. Each bolt B is inserted in one of the bolt insertion holes BH (for example, five bolt insertion holes BH) formed in the cylinder blocks 11, 12, the front housing member 13, and the rear housing member 14. A threaded portion N formed at the distal end of each bolt B is screwed to the rear housing member 14. The diameter of the bolt insertion holes BH is greater than the diameter of the bolts B. When each bolt B is inserted in the corresponding bolt insertion hole BH, a hollow space S is defined in each bolt insertion hole BH.

A front discharge chamber 13*a* and a front suction chamber 13*b* are defined in the front housing member 13. The front suction chamber 13*b* is connected to each bolt insertion hole BH via a communication passage R1 formed in the front housing member 13. Also, a rear discharge chamber 14*a* and a rear suction chamber 14*b* are defined in the rear housing member 14.

A suction hole P is formed in the outer circumferential surface of the front cylinder block 11 and extends to the inner circumferential surface of the front cylinder block 11. The suction hole P is connected to an external refrigerant circuit provided outside of the compressor 10. A discharge hole, which is not shown, is formed in the outer circumferential surface of the front cylinder block 11 and extends to the inner circumferential surface of the front cylinder block 11. The discharge hole is connected to the external refrigerant circuit.

When the compressor 10 is used to configure a refrigerant circuit of a vehicle air conditioning system, the external refrigerant circuit connects a discharge pressure zone of the compressor 10 to a suction pressure zone of the compressor 10. The external refrigerant circuit includes a condenser, an expansion valve, and an evaporator. The condenser, the expansion valve, and the evaporator are arranged in this order in the external refrigerant circuit from the discharge pressure zone of the compressor 10.

A front valve plate 15, a discharge flap plate 16, a front retainer plate 17, and a suction flap plate 18 are arranged between the front housing member 13 and the front cylinder block 11. The front valve plate 15 includes front discharge ports 15*a* formed at positions corresponding to the front discharge chamber 13*a*, and front suction ports 15*b* formed at positions corresponding to the front suction chamber 13*b*. Also, the discharge flap plate 16 includes front discharge valves 16*a* formed at positions corresponding to the front discharge ports 15*a*. The front discharge valves 16*a*, which are flap valves, selectively open and close the front discharge ports 15*a*. The valve dimension of the front discharge valves 16*a* formed in the discharge flap plate 16 is set to a dimension X. The valve dimension refers to the dimension from the proximal end of each front discharge valve 16*a*, which is held by a partition wall defining the front discharge chamber 13*a* in the front housing member 13, to the distal end of the front discharge valve 16*a*. Front discharge retainers 17*a*, which restrict the opening degree of the front discharge valves 16*a*, are formed on the front retainer plate 17. Also, the suction flap plate 18 has flap valves 18*a*, which are formed at positions corresponding to the front suction ports 15*b*. The flap valves 18*a* selectively open and close the front suction ports 15*b*. The front cylinder block 11 has notches 11*c*, which are formed to correspond to the flap valves 18*a*. The wall of each notch 11*c* functions as a front suction retainer, which restricts the opening degree of the associated flap valve 18*a*.

A valve plate 19, a discharge flap plate 20, and a retainer plate 21 are arranged between the rear housing member 14 and the rear cylinder block 12. Discharge ports 19*a* are formed in the valve plate 19 at positions corresponding to the discharge chamber 14*a*. Also, rear discharge valves 20*a* are formed in the discharge flap plate 20 at positions corresponding to the discharge ports 19*a*. The rear discharge valves 20*a*, which are flap valves, selectively open and close the discharge ports 19*a*. The dimension of the rear discharge valves 20*a* formed in the discharge flap plate 20 is set to a dimension X. The valve dimension refers to a dimension from the proximal end of each rear discharge valve 20*a*, which is held by a partition wall defining the discharge chamber 14*a* in the rear housing member 14, to the distal end of the rear discharge valve 20*a*. In the first embodiment, the valve dimension (dimension X) of the front discharge valves 16*a* is equal to the valve dimension (dimension X) of the rear discharge valves 20*a*. That is, the discharge flap plates 16, 20 have the same structure and include the discharge valves 16*a*, 20*a* having the same dimension, respectively. Also, retainers 21*a*, which restrict the opening degree of the rear discharge valves 20*a*, are formed on the retainer plate 21.

The cylinder blocks 11, 12 rotatably support a rotary shaft 22. The rotary shaft 22 is inserted in shaft holes 11*a*, 12*a*, which extend through the cylinder blocks 11, 12. The rotary shaft 22 is also inserted in a through hole 15*c*, which is formed at the center of the front valve plate 15. The outer circumferential surface of the rotary shaft 22 and the inner circumferential surface of the through hole 15*c* configure a sliding portion of the rotary shaft 22. The rotary shaft 22 is directly supported by the cylinder blocks 11, 12 via the shaft holes 11*a*, 12*a*. A lip-seal-type shaft sealing assembly 23 is arranged between the front housing member 13 and the rotary shaft 22. The shaft sealing assembly 23 is accommodated in a seal chamber 13*c*, which if formed in the front housing member 13. The front discharge chamber 13*a* and the front suction chamber 13*b* are located around the seal chamber 13*c*.

A swash plate 24 is secured to the rotary shaft 22 and operates together with the rotary shaft 22. The swash plate 24 is located in a swash plate chamber 25, which is defined between the cylinder blocks 11, 12. A thrust bearing 26 is arranged between the end surface of the front cylinder block 11 and an annular proximal portion 24*a* of the swash plate 24. A thrust bearing 27 is arranged between the end surface of the rear cylinder block 12 and the proximal portion 24*a* of the swash plate 24. The thrust bearings 26, 27 sandwich the swash plate 24 and restrict the movement of the swash plate 24 along the axis L of the rotary shaft 22.

Front cylinder bores 28 (five in the first embodiment, only one of the front cylinder bores 28 is shown in FIG. 1) are formed in the front cylinder block 11 and are arranged around the rotary shaft 22. Also, rear cylinder bores 29 (five in the first embodiment, only one of the rear cylinder bores 29 is shown in FIG. 1) are formed in the rear cylinder block 12 and are arranged around the rotary shaft 22. Each pair of the front and rear cylinder bores 28, 29 accommodate a double-headed piston 30. The cylinder blocks 11, 12 configure cylinders for the double-headed pistons 30. Also, a communication passage R2, which connects the swash plate chamber 25 to the rear suction chamber 14*b*, is formed in the rear cylinder block 12 and the rear housing member 14.

The swash plate 24 coacts with the rotary shaft 22 and rotates integrally with the rotary shaft 22. The rotation of the swash plate 24 is transmitted to the double-headed pistons 30 through pairs of shoes 31, which sandwich the swash plate 24. As a result, each double-headed piston 30 reciprocates back and forth in the associated cylinder bores 28, 29. In each pair of the cylinder bores 28, 29, the associated double-headed piston 30 defines a first compression chamber, which is a front compression chamber 28*a* in the first embodiment, and a second compression chamber, which is a rear compression chamber 29*a* in the first embodiment. Sealing circumferential surfaces 11*b*, 12*b* are formed on the inner circumferential surfaces of the shaft holes 11*a*, 12*a* through which the rotary shaft 22 is inserted. The rotary shaft 22 is directly supported by the cylinder blocks 11, 12 at the sealing circumferential surfaces 11*b*, 12*b*. In the first embodiment, the suction hole P and the bolt insertion holes BH are open to the swash plate chamber 25 of the compressor 10.

An introduction passage, which is a supply passage 22*a* in the first embodiment, is formed in the rotary shaft 22. The supply passage 22*a* is a bore-like passage bored in the end surface of the rotary shaft 22 that is closer to the rear housing member 14. The rotary shaft 22 is a solid shaft. Thus, one end of the supply passage 22*a* is open to the rear suction chamber 14*b* of the rear housing member 14. Also, a communication passage 32 is formed in the rotary shaft 22 at a position corresponding to the rear cylinder block 12 to be connected to the supply passage 22*a*. The opening of the communication passage 32 at the outer circumferential surface of the rotary shaft 22 functions as an outlet 32*b* of the communication passage 32. Also, suction passages 33 (five in the first embodiment, only one of the suction passages 33 is shown in FIG. 1) are formed in the rear cylinder block 12 to connect the rear cylinder bores 29 to the shaft hole 12*a*. Each suction passage 33 has an inlet 33*a*, which opens in the sealing circumferential surface 12*b*, and an outlet 33*b*, which opens toward the associated rear compression chamber 29*a*. As the rotary shaft 22 rotates, the outlet 32*b* of the communication passage 32 is intermittently connected to the inlet 33*a* of each suction passage 33. Part of the rotary shaft 22 surrounded by the sealing circumferential surface 12*b* functions as a rotary valve 35 formed integrally with the rotary shaft 22.

In the compressor 10 according to the first embodiment, the mechanism for drawing in refrigerant (gas) to the front compression chambers 28*a* differs from the mechanism for drawing in refrigerant to the rear compression chambers 29*a*. More specifically, the mechanism for drawing in refrigerant to the front compression chambers 28*a* includes the flap valves 18*a* located between the front suction chamber 13*b* and the front compression chambers 28*a*. Each flap valve 18*a* selectively opens and closes in accordance with the difference between the pressure in the front suction chamber 13*b* and the pressure in the associated front compression chamber 28*a*. The mechanism for drawing in refrigerant to the rear compression chambers 29*a* includes the rotary valve 35, which is located between the rear suction chamber 14*b* and the rear compression chambers 29*a*. The rotary valve 35 includes the supply passage 22*a*, which introduces refrigerant (gas) in the front suction chamber 13*b* to the rear compression chambers 29*a*.

The compression chambers into which refrigerant is drawn in by the rotary valve 35 are referred to as first compression chambers, and the compression chambers into which refrigerant is drawn in by the flap valves 18*a* are referred to as second compression chambers. In the first embodiment, the front compression chambers 28*a* are the second compression chambers, and the rear compression chambers 29*a* are the first compression chambers. According to the compressor 10 configured as described above, when a suction stroke takes place in each front cylinder bore 28, that is, when each double-headed piston 30 moves from the left side to the right side in FIG. 1, the refrigerant in the front suction chamber 13*b* is drawn into the associated front compression chamber 28*a* via the corresponding flap valve 18*a*. That is, as shown by arrows in FIG. 1, refrigerant in the external refrigerant circuit is drawn into the swash plate chamber 25 via the suction hole P, and then flows through the bolt insertion holes BH and the communication passages R1 until the refrigerant reaches the front suction chamber 13*b* in the front housing member 13. In accordance with the difference between the pressure in the front suction chamber 13*b* and the pressure in each front compression chamber 28*a* (front cylinder bore 28), refrigerant in the front suction chamber 13*b*, which functions as the suction pressure zone, presses open the associated flap valve 18*a* and flows into the front compression chamber 28*a* from the corresponding front suction port 15*b*.

When a discharge stroke takes place in each front cylinder bore 28, that is, when each double-headed piston 30 moves from the right side to the left side in FIG. 1, the refrigerant in the associated front compression chamber 28*a* flows out from the corresponding front discharge port 15*a* pressing open the associated front discharge valve 16*a*, and is discharged into the front discharge chamber 13*a*, which functions as the discharge pressure zone. The refrigerant discharged into the front discharge chamber 13*a* flows through a communication passage, which is not shown, and flows to the external refrigerant circuit from the discharge hole. Lubricant is provided in the refrigerant circuit, which is configured by the compressor 10 and the external refrigerant circuit, and the lubricant flows with the refrigerant.

When a suction stroke takes place in each rear cylinder bore 29, that is, when each double-headed piston 30 moves from the right side to the left side in FIG. 1, the outlet 32*b* of the communication passage 32 is connected to the inlet 33*a* of the associated suction passage 33. Thus, the refrigerant in the rear suction chamber 14*b* is drawn into the associated rear compression chamber 29*a* via the rotary valve 35. That is, as shown by arrows in FIG. 1, the refrigerant in the external refrigerant circuit is drawn into the swash plate chamber 25 through the suction hole P, and then reaches the rear suction chamber 14*b* via the communication passage R2. The refrigerant in the rear suction chamber 14*b*, which functions as the suction pressure zone, flows through the supply passage 22*a*, the communication passage 32, and the suction passages 33, and is drawn into the rear compression chambers 29*a* of the rear cylinder bores 29 by the operation of the rotary valve 35.

When a discharge stroke takes place in each rear cylinder bore 29, that is, when each double-headed piston 30 moves from the left side to the right side in FIG. 1, the refrigerant in the associated rear compression chamber 29*a* flows out from the corresponding discharge port 19*a* pressing open the associated rear discharge valve 20*a*, and is discharged into the rear discharge chamber 14*a*, which functions as the discharge pressure zone. The refrigerant discharged to the rear discharge chamber 14*a* flows through a communication passage, which is not shown, and flows to the external refrigerant circuit through the discharge hole.

The operation of the compressor 10 according to the first embodiment will now be described with reference to FIG. 2.

Measurement was carried out on two types of experimental apparatuses of a refrigerant circuit including a double-headed piston type compressor and an external connect circuitry. FIG. 2 shows the measurement results of the suction pulsation of the compressor. In other words, FIG. 2 shows the measurement result of the suction pulsation of the compressor in an apparatus A1 according to the present invention that has the property shown by a broken line A1, and the measurement result of the suction pulsation of the compressor in a conventional apparatus A2, that has the property shown by a solid line A2. The compressor of the apparatus A1 according to the present invention includes, like the compressor 10 of the first embodiment, a refrigerant suction mechanism configured by flap valves and a refrigerant suction mechanism configured by a rotary valve. The compressor of the conventional apparatus A2 includes, like the conventional compressor, the refrigerant suction mechanisms configured by flap valves on both sides of the compressor. In the apparatus A1 according to the present invention and the conventional apparatus A2, only the refrigerant suction mechanisms of the compressor are different, and other structures, for example, the structures of the external refrigerant circuit are set to have the same conditions.

Figure 2:
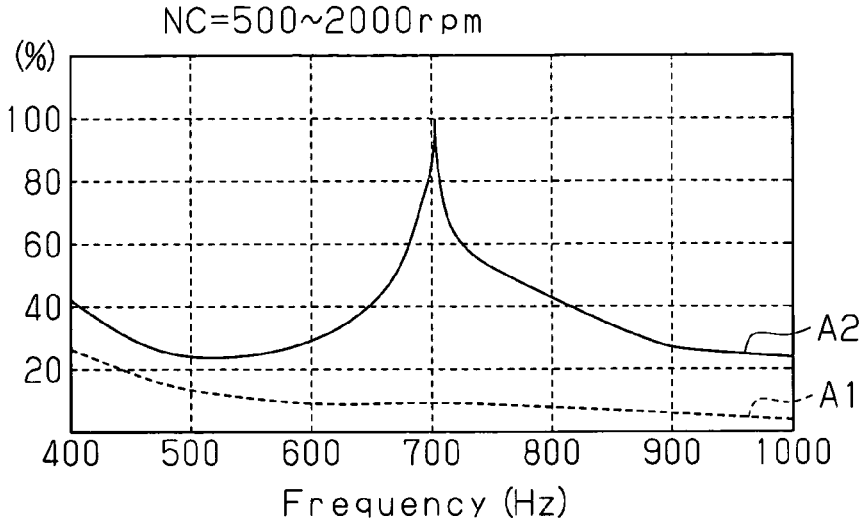
FIG. 2 is a graph showing suction pulsation of the compressor shown in FIG. 1 and a conventional compressor.

FIG. 2 shows the suction pulsation in a specific frequency band when the rotation speed NC of the compressor is in the low rotation speed range, which is 500 to 2000 rpm. In the first embodiment, the rotation speed range is set to a range of the rotation speed NC in which self-excited vibration is generated in suction valves, and sound generated by the vibration might become noise to occupants in the vehicle compartment. When self-excited vibration is generated in the flap valves, which function as the suction valves, the vibration is transmitted to the evaporator via a conduit, and consequently, vibrating sound of the conduit and the evaporator is generated. The specific frequency band is set to 400 to 1000 Hz, which is the range of a resonant frequency of the evaporator used in the external refrigerant circuit.

As apparent from the measurement result in FIG. 2, the suction pulsation of the apparatus A1 according to the present invention is less than the suction pulsation of the conventional apparatus A2 in the entire frequency band of 400 to 1000 Hz. That is, the refrigerant circuit using the apparatus A1 according to the present invention had less noise due to the reduction in the suction pulsation of the entire compressor 10. Furthermore, according to the apparatus A1 of the present invention, the reduction rate of the suction pulsation was the greatest at 700 Hz at which the suction pulsation of the conventional apparatus A2 comes to the peak. More specifically, according to the apparatus A1 of the present invention, the reduction rate of the suction pulsation at 700 Hz reached approximately 90% when the peak value of the suction pulsation of the conventional apparatus A2 is set to 100%. Furthermore, the reduction rate of the suction pulsation of the apparatus A1 according to the present invention with respect to the conventional apparatus A2 was greater than 50% in most part of the frequency band of 400 to 1000 Hz.

In the compressor 10 of the first embodiment, the mechanism for drawing in refrigerant to the front compression chambers 28*a* is configured by the flap valves 18*a*, and the mechanism for drawing in refrigerant to the rear compression chambers 29*a* is configured by the rotary valve 35. The flap valves 18*a* and the rotary valve 35 behave (move) differently when drawing in refrigerant due to the structural difference. That is, since the flap valves 18*a* are selectively opened and closed by the pressure difference, a delay occurs in opening and closing the flap valves 18*a* when drawing in refrigerant to the front compression chambers 28*a*. In contrast, the rotary valve 35 is provided on the rotary shaft 22 and operates together with the rotary shaft 22. Thus, when drawing in refrigerant to the rear compression chambers 29*a*, refrigerant is forcibly drawn into each rear compression chamber 29*a* when the supply passage 22*a* (communication passage 32) is connected to the rear compression chamber 29*a*. Due to such difference in the behavior, a phase difference occurs between the time at which refrigerant is drawn into each of the front compression chambers 28*a*, and the time at which refrigerant is drawn into each of the rear compression chambers 29*a*. Therefore, the amount of refrigerant drawn into the front compression chambers 28*a* is less than the amount of refrigerant drawn into the rear compression chambers 29*a*.

That is, the density of the refrigerant in the front compression chambers 28*a* after the suction stroke is less than that in the rear compression chambers 29*a* after the suction stroke. Thus, when shifting from the suction stroke to the discharge stroke, a phase difference occurs between the time at which refrigerant is discharged from each of the front compression chambers 28*a* and the time at which refrigerant is discharged from each of the rear compression chambers 29*a*. That is, a phase difference occurs between the time at which refrigerant is discharged from each of the front compression chambers 28*a* to the front discharge chamber 13*a* and the time at which refrigerant is discharged from each of the rear compression chambers 29*a* to the rear discharge chamber 14*a*. The time at which refrigerant is discharged from each of the front compression chambers 28*a* to the front discharge chamber 13*a* is later than the time at which refrigerant is discharged from each of the rear compression chambers 29*a* to the rear discharge chamber 14*a*. As a result, according to the compressor 10 of the first embodiment, the peak value of the pulsation waveform at a specific degree does not become extremely high, and the peak value is reduced. That is, discharge pulsation of the compressor 10 is reduced.

For example, cases will be discussed below in which the mechanism for drawing in refrigerant to the front compression chambers 28*a* and the mechanism for drawing in refrigerant to the rear compression chambers 29*a* are both configured by the flap valves or the rotary valves. In these cases, the mechanism for drawing in refrigerant to the front compression chambers 28*a* and the mechanism for drawing in refrigerant to the rear compression chambers 29*a* show the same behavior (motion) when drawing in refrigerant. Thus, a phase difference does not occur between the time at which refrigerant is drawn into the front compression chambers 28*a* and the time at which refrigerant is drawn into the rear compression chambers 29*a*. Since there is no difference between the density of refrigerant in the front compression chambers 28*a* and the density of refrigerant in the rear compression chambers 29*a*, no difference occurs between the time at which refrigerant is discharged from the front compression chambers 28*a* and the time at which refrigerant is discharged from the rear compression chambers 29*a*. In this manner, when the mechanism for drawing in refrigerant to the front compression chambers 28*a* is the same as the mechanism for drawing in refrigerant to the rear compression chambers 29*a*, the discharge pulsation at a specific degree always occurs in a concentrated manner, thereby increasing the peak value of the pulsation waveform. As a result, the noise caused by vibration might raise a problem.

The first embodiment has the following advantages.

(1) The mechanism for drawing in refrigerant to the front compression chambers 28*a* differs from the mechanism for drawing in refrigerant to the rear compression chambers 29*a*. In the first embodiment, the refrigerant suction mechanism close to the front compression chambers 28*a* is configured by the flap valves 18*a*, and the refrigerant suction mechanism close to the rear compression chambers 29*a* is configured by the rotary valve 35. This reduces the suction pulsation in the compressor 10. Accordingly, the pulsation of the compressor 10 is reduced, thereby suppressing generation of noise. Thus, the quiet compressor 10 is achieved.

(2) The suction hole P, which is connected to the external refrigerant circuit, is provided in the cylinder block 11. That is, refrigerant is supplied to the front compression chambers 28*a* and the rear compression chambers 29*a* via the swash plate chamber 25. Therefore, the refrigerant is distributed from the center of the compressor 10 to the front compression chambers 28*a* and the rear compression chambers 29*a*. This suppresses decrease in the suction efficiency. That is, the suction efficiency is prevented from being reduced in either of the compression chambers 28*a*, 29*a*.

(3) The supply passage 22*a* of the rotary valve 35 is a bore-like passage that opens in the end of the rotary shaft 22. Thus, refrigerant is supplied to the rotary valve 35 via the opening end of the rotary shaft 22, which increases the refrigerant suction efficiency. That is, since the supply passage 22*a* is always connected to the rear suction chamber 14*b* and is always rotated at a fixed position, refrigerant is easily supplied.

(4) The rotary valve 35 having the bore-like passage is provided close to the rear housing member 14. If, for example, the bore-like passage is provided in the rotary shaft 22 and the rotary valve is provided close to the front housing member 13, the bore-like passage must be provided in the rotary shaft 22 extending from the rear housing member 14 to the front housing member 13. This reduces the strength of the rotary shaft 22. In contrast, in the case where the rotary valve 35, which has the bore-like passage, is provided close to the rear housing member 14 as in the first embodiment, the bore-like passage is provided only in part of the rotary shaft 22 close to the rear housing member 14. Thus, the first embodiment suppresses decrease in the strength of the rotary shaft 22. That is, the first embodiment is advantageous in securing the strength of the rotary shaft 22 and facilitates machining of the rotary shaft 22.

(5) The rotary valve 35 is provided close to the rear housing member 14. Thus, as compared to a case where, for example, a rotary valve is provided close to the front housing member 13, which is provided with the shaft sealing assembly 23 and thus lacks in space, the first embodiment allows a passage for drawing refrigerant to the rotary valve to be easily created. In the first embodiment, the supply passage 22*a* functions as the passage for drawing in refrigerant to the rotary valve 35.

Providing the rotary valve 35 close to the rear housing member 14 is also advantageous in view of load as compared to a case where the rotary valve is provided close to the front housing member 13, which receives a great load such as torsion and bend. That is, the case where the rotary valve 35 is provided close to the front housing member 13 has a greater possibility of causing slight deformation in the rotary valve (35) and the cylinder blocks (11, 12) due to adverse effect of the load as compared to the case where the rotary valve 35 is provided close to the rear housing member 14. The deformation might cause a gap between the rotary valve (35) and the cylinder blocks (11, 12). Furthermore, the deformation might cause refrigerant to leak from between the suction passages (33), which connect the cylinder bores (28, 29) to the shaft holes (11*a*, 12*a*). As a result, the suction efficiency of the rotary valve (35) might be reduced, which might reduce the efficiency of the compressor. Thus, the first embodiment in which the rotary valve 35 is provided close to the rear housing member 14 suppresses deformation of the rotary valve 35 and the rear cylinder block 12. As a result, reduction in the suction efficiency of the rotary valve 35 is suppressed, which further suppresses the reduction in the efficiency of the compressor.

(6) Furthermore, the rotary valve 35 is provided close to the rear housing member 14, and the rear suction chamber 14*b*, which is always connected to the rotary valve 35, is formed in the rear housing member 14. Thus, refrigerant can be temporarily stored in the rear suction chamber 14*b*. That is, refrigerant is easily drawn into the rotary valve 35.

(7) The valve dimension of the front discharge valves 16*a* is set equal to the valve dimension of the rear discharge valves 20*a*. Thus, the discharge structures on both ends of the compressor 10 have the same structure, which suppresses increase in the manufacturing costs.

A second embodiment of the present invention will now be described with reference to FIG. 4. In the embodiments described below, like or the same reference numerals are given to those components that are like or the same as the corresponding components of the first embodiment, and detailed explanations are omitted or simplified.

Figure 4:
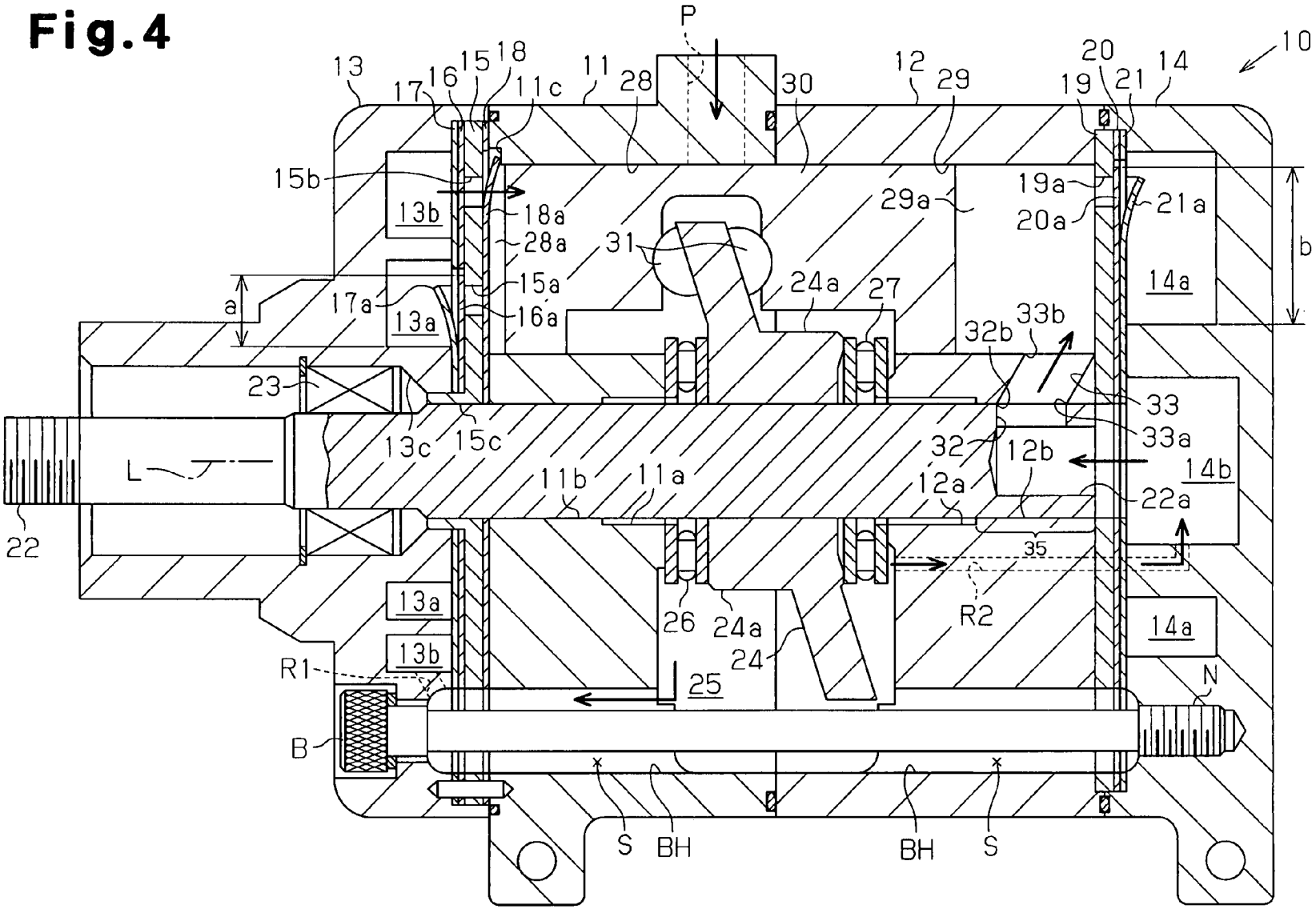
FIG. 4 is a cross-sectional view illustrating a double-headed piston type compressor according to a second embodiment of the present invention.

As shown in FIG. 4, in the second embodiment, the valve dimension b of the rear discharge valves 20*a* in the discharge flap plate 20 is set greater than the valve dimension a of the front discharge valves 16*a* in the discharge flap plate 16 (a<b). That is, the valve dimension of the front discharge valves 16*a* in the front discharge chamber 13*a* differs from the valve dimension of the rear discharge valves 20*a* in the rear discharge chamber 14*a*. Since the valve dimension of the front discharge valves 16*a* differs from the valve dimension of the rear discharge valves 20*a*, the rigidity of the front discharge valves 16*a* differs from the rigidity of the rear discharge valves 20*a*. Thus, the behavior of the front discharge valves 16*a* differs from the behavior of the rear discharge valves 20*a* during opening and closing. Therefore, a phase difference occurs between the time at which refrigerant is discharged from each of the front compression chambers 28*a* to the front discharge chamber 13*a*, and the time at which refrigerant is discharged from each of the rear compression chambers 29*a* to the rear discharge chamber 14*a*. Thus, together with the pulsation reduction effect achieved by the refrigerant suction mechanism configured by the flap valves 18*a* and the refrigerant suction mechanism configured by the rotary valve 35, the peak value of the pulsation at the specific degree is further reduced.

The second embodiment has the following advantages in addition to the advantages (1) to (6) of the first embodiment.

(8) The valve dimension of the front discharge valves 16*a* for discharging the refrigerant drawn in through the flap valves 18*a* differs from the valve dimension of the rear discharge valves 20*a* for discharging the refrigerant drawn in through the rotary valve 35. Thus, when discharging refrigerant from each of the front compression chambers 28*a* and each of the rear compression chambers 29*a*, the discharge valves 16*a*, 20*a* behave differently, and a phase difference is generated between the times at which refrigerant is discharged. This further reduces the discharge pulsation of the compressor 10.

A third embodiment of the present invention will now be described with reference to FIG. 5.

Like the compressor 10 of the first and second embodiments, in the compressor 10 according to the third embodiment, the mechanism for drawing in refrigerant to the front compression chambers 28*a* is configured by the flap valves 18*a*, and the mechanism for drawing in refrigerant to the rear compression chambers 29*a* is configured by the rotary valve 35. The third embodiment differs from the first and second embodiments in the structure of a passage for supplying refrigerant to the rear compression chambers 29*a* via the rotary valve 35. The structure of the passage according to the third embodiment will mainly be discussed below.

An introduction passage, which is a supply passage 22*b* in the third embodiment, is formed in the rotary shaft 22. The supply passage 22*b* of the third embodiment includes a bore-like passage section 36 and a groove-like passage section 37, which is provided next to the bore-like passage section 36. The bore-like passage section 36 is formed by boring the end face of the rotary shaft 22, which is a solid shaft. The groove-like passage section 37 is formed by machining a groove on the outer circumferential surface of the rotary shaft 22. Furthermore, a communication passage R3 is formed in the rear cylinder block 12 to connect the swash plate chamber 25 to the shaft hole 12*a*. The groove-like passage section 37 is formed to connect each of the suction passages 33 in the rear cylinder block 12 to the communication passage R3.

Figure 5:
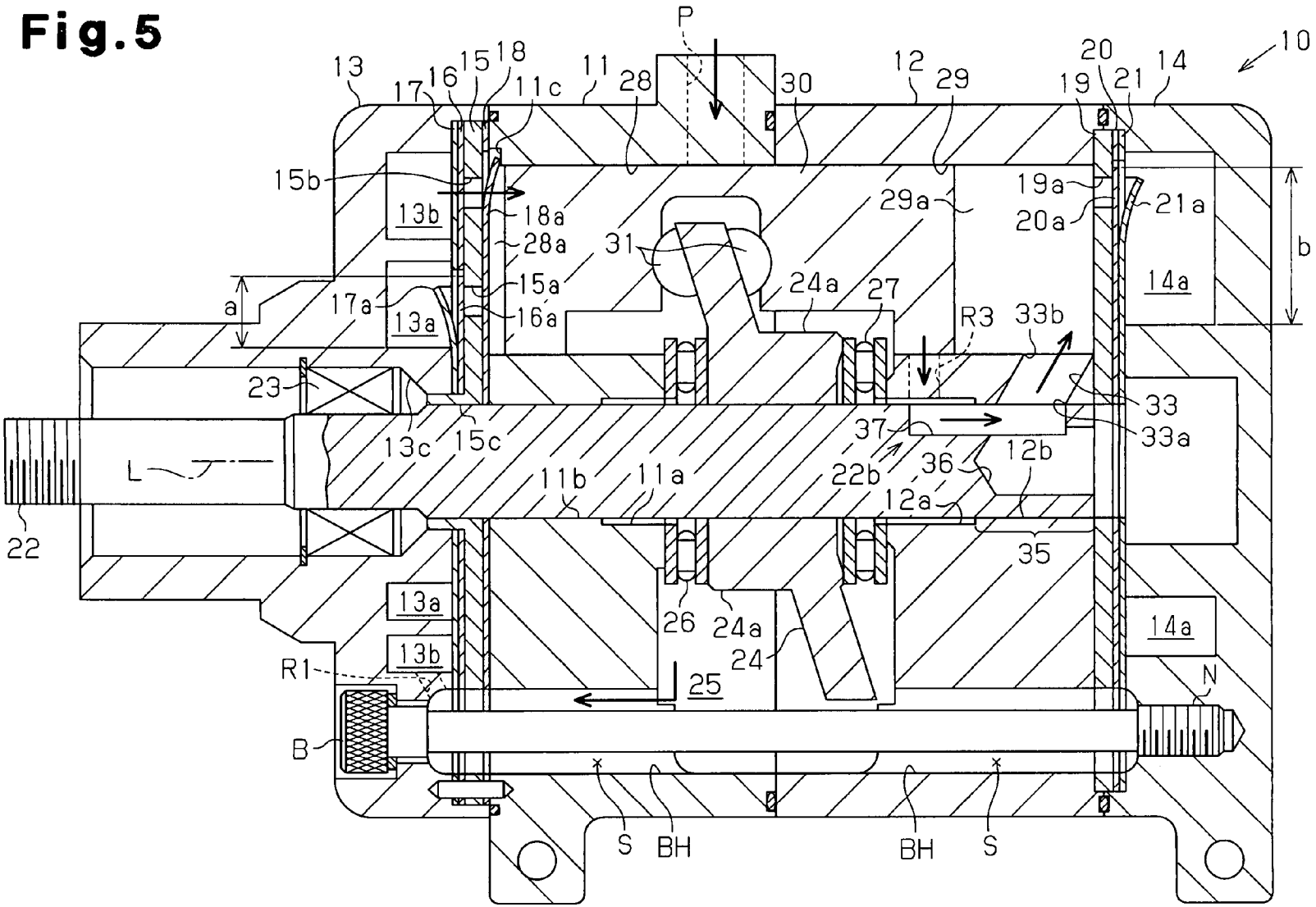
FIG. 5 is a cross-sectional view illustrating a double-headed piston type compressor according to a third embodiment of the present invention.

In the compressor 10 configured as described above, when a suction stroke takes place in each rear cylinder bore 29, that is, when each double-headed piston 30 moves from the right side to the left side in FIG. 5, the groove-like passage section 37 of the supply passage 22*b* is connected to the inlet 33*a* of the associated suction passage 33. The refrigerant in the swash plate chamber 25, which functions as the suction pressure zone, is drawn into the associated rear compression chamber 29*a* via the rotary valve 35. That is, as shown by arrows in FIG. 5, the refrigerant in the external refrigerant circuit is drawn into the swash plate chamber 25 through the suction hole P, then flows through the communication passage R3, and reaches the groove-like passage section 37 of the supply passage 22*b*. Thereafter, the refrigerant in the supply passage 22*b* is drawn into the rear compression chamber 29*a* via the corresponding suction passage 33 by the operation of the rotary valve 35.

When a discharge stroke takes place in each rear cylinder bore 29, that is, when each double-headed piston 30 moves from the left side to the right side in FIG. 5, the refrigerant in the associated rear compression chamber 29*a* flows out from the corresponding discharge port 19*a* pressing open the associated rear discharge valve 20*a*, and is discharged into the rear discharge chamber 14*a*, which functions as the discharge pressure zone. The refrigerant discharged to the rear discharge chamber 14*a* flows through a communication passage, which is not shown, and flows to the external refrigerant circuit through the discharge hole. When a suction stroke or a discharge stroke takes place in each front cylinder bore 28, the flow of refrigerant is the same as that in the first and second embodiments. Since the compressor 10 according to the third embodiment includes the refrigerant suction mechanism configured by the flap valves 18*a* and the refrigerant suction mechanism configured by the rotary valve 35, the same advantages as those of the compressor 10 according to the first and second embodiments are obtained.

Therefore, the third embodiment has the following advantages in addition to the advantages (1), (2), (5), (6) of the first embodiment and the advantage (8) of the second embodiment.

(9) The supply passage 22*b* of the rotary valve 35 is formed by the combination of the bore-like passage section 36 and the groove-like passage section 37. Thus, the volume of refrigerant drawn into the rotary valve 35 is increased.

A fourth embodiment of the present invention will now be described with reference to FIG. 6.

In the compressor 10 of the fourth embodiment, the mechanism for drawing in refrigerant to the front compression chambers 28*a* is configured by a rotary valve 49, and the mechanism for drawing in refrigerant to the rear compression chambers 29*a* is configured by flap valves 46*a*. That is, the positions of the two refrigerant suction mechanisms of the compressor 10 according to the fourth embodiment are reversed with respect to those in the first to third embodiments.

In other words, the compression chambers into which refrigerant is drawn in by the rotary valve 49 are referred to as the first compression chambers, and the compression chambers into which refrigerant is drawn in by the flap valves 46*a* are referred to as the second compression chambers. In the fourth embodiment, the front compression chambers 28*a* are the first compression chambers, and the rear compression chambers 29*a* are the second compression chambers.

In the fourth embodiment, the front housing member 13 includes only the front discharge chamber 13*a*, and the front suction chamber 13*b* is omitted. The rear housing member 14 includes the rear discharge chamber 14*a* and the rear suction chamber 14*b*. A valve plate 40, a discharge flap plate 41, and a retainer plate 42 are arranged between the front housing member 13 and the front cylinder block 11. Front discharge ports 40*a* are formed in the valve plate 40 at positions corresponding to the front discharge chamber 13*a*. Also, front discharge valves 41*a* are formed in the discharge flap plate 41 at positions corresponding to the front discharge ports 40*a*. Retainers 42*a*, which restrict the opening degree of the front discharge valves 41*a*, are formed in the retainer plate 42.

A valve plate 43, a discharge flap plate 44, a retainer plate 45, and a suction flap plate 46 are arranged between the rear housing member 14 and the rear cylinder block 12. The valve plate 43 includes rear discharge ports 43*a*, which are formed at positions corresponding to the rear discharge chamber 14*a*, and rear suction ports 43*b*, which are formed at positions corresponding to the rear suction chamber 14*b*. The discharge flap plate 44 includes rear discharge valves 44*a*, which are formed at positions corresponding to the rear discharge ports 43*a*. In the fourth embodiment, the valve dimension c of the front discharge valves 41*a* is set greater than the valve dimension d of the rear discharge valves 44*a* (c>d). The retainer plate 45 includes retainers 45*a*, which restrict the opening degree of the rear discharge valves 44*a*. The suction flap plate 46 includes the flap valves 46*a*, which are formed at positions corresponding to the rear suction ports 43*b*. The flap valves 46*a* selectively open and close the rear suction ports 43*b*. The rear cylinder block 12 includes notches 12*c* formed to correspond to the flap valves 46*a*. The wall surface of each notch 12*c* functions as a rear suction retainer, which restricts the opening degree of the associated flap valve 46*a*.

The rotary shaft 22 includes an introduction passage, which is a supply passage 47 in the fourth embodiment. The supply passage 47 of the fourth embodiment is a groove-like passage formed by machining a groove in the outer circumferential surface of the rotary shaft 22, which is a solid shaft. One end of the supply passage 47 is open to the seal chamber 13*c*, which accommodates the shaft sealing assembly 23. Also, suction passages 48 (five in this embodiment, only one of the suction passages 48 is shown in FIG. 6) are formed in the front cylinder block 11 to connect the front cylinder bores 28 to the shaft hole 11*a*. An inlet 48*a* of each suction passage 48 is open in the sealing circumferential surface 11*b* at a position corresponding to the supply passage 47. An outlet 48*b* of the suction passage 48 is open toward the associated front compression chamber 28*a*. As the rotary shaft 22 rotates, the inlet 48*a* of each suction passage 48 is intermittently connected to the supply passage 47. Part of the rotary shaft 22 surrounded by the sealing circumferential surface 11*b* functions as the rotary valve 49 formed integrally with the rotary shaft 22.

Furthermore, a communication passage 50 is formed through the front housing member 13 and the front cylinder block 11. The communication passage 50 is located at a lower section of the cylinder block 11, and extends between two adjacent cylinder bores 28. An inlet 50*a* of the communication passage 50 is open to the swash plate chamber 25, and an outlet 50*b* of the communication passage 50 is open to the seal chamber 13*c*. That is, the communication passage 50 connects the seal chamber 13*c* to the swash plate chamber 25. Communication passages R4 are also formed in the rear housing member 14 to connect the rear suction chamber 14*b* to the bolt insertion holes BH.

Figure 6:
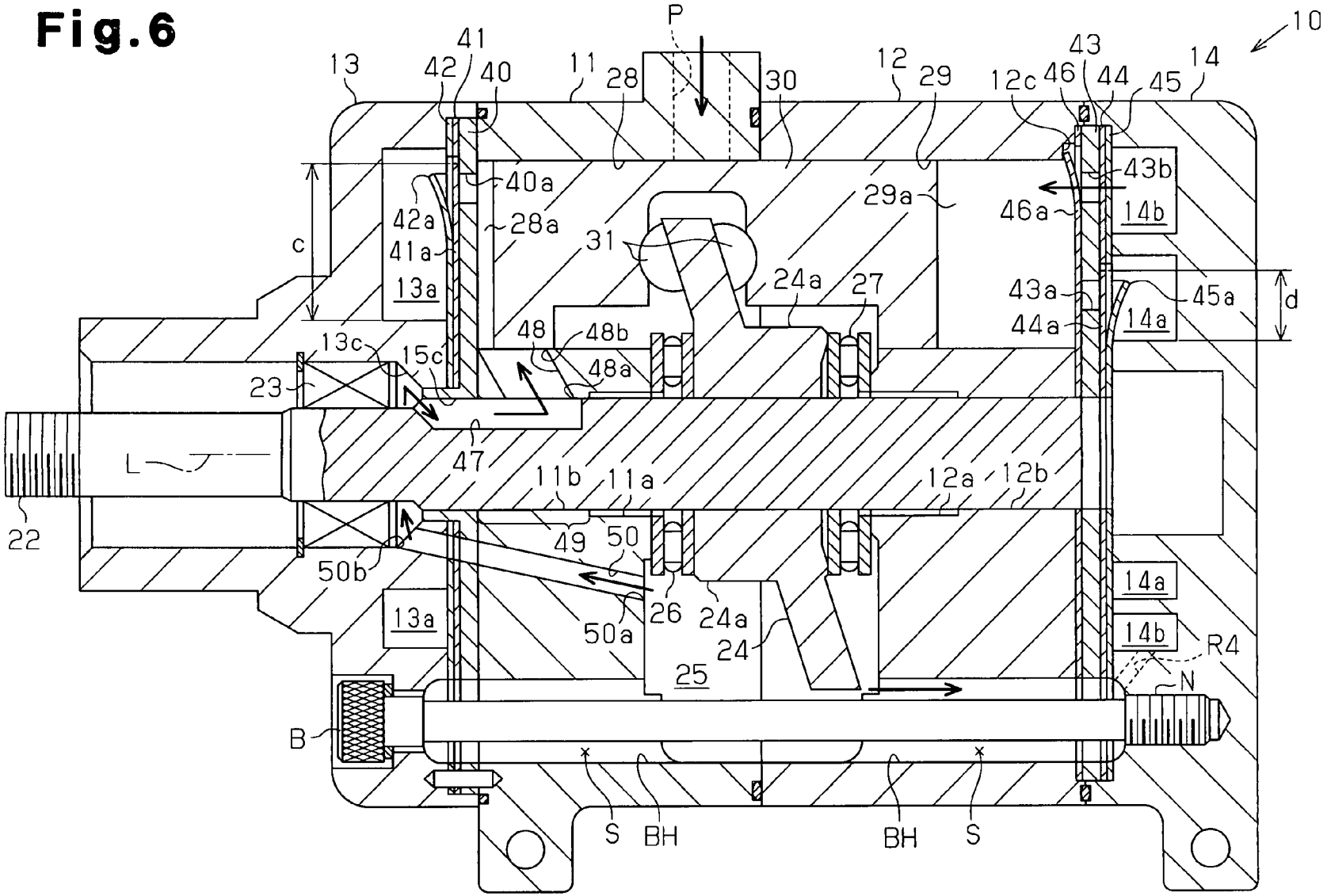
FIG. 6 is a cross-sectional view illustrating a double-headed piston type compressor according to a fourth embodiment of the present invention.

In the compressor 10 configured as described above, when a suction stroke takes place in each front cylinder bore 28, that is, when each double-headed piston 30 moves from the left side to the right side in FIG. 6, the supply passage 47 is connected to the inlet 48*a* of the associated suction passage 48, and refrigerant is drawn into the associated front compression chamber 28*a* via the rotary valve 49. That is, as shown by arrows in FIG. 6, the refrigerant in the external refrigerant circuit is drawn into the swash plate chamber 25 through the suction hole P, and then flows through the communication passage 50 until the refrigerant reaches the seal chamber 13*c*. Then, the refrigerant in the seal chamber 13*c*, which functions as the suction pressure zone, is drawn into the front compression chamber 28*a* via the supply passage 47 and the associated suction passage 48 by the operation of the rotary valve 49.

When a discharge stroke takes place in each front cylinder bore 28, that is, when each double-headed piston 30 moves from the right side to the left side in FIG. 6, the refrigerant in the associated front compression chamber 28*a* flows out from the associated front discharge port 40*a* pressing open the corresponding front discharge valve 41*a*, and is discharged to the front discharge chamber 13*a*, which functions as the discharge pressure zone. Then, the refrigerant discharged to the front discharge chamber 13*a* flows through a communication passage, which is not shown, and flows to the external refrigerant circuit from the discharge hole.

When a suction stroke takes place in each rear cylinder bore 29, that is, when each double-headed piston 30 moves from the right side to the left side in FIG. 6, the refrigerant in the rear suction chamber 14*b* is drawn into the associated rear compression chamber 29*a* via the corresponding flap valve 46*a*. That is, as shown by arrows in FIG. 6, the refrigerant in the external refrigerant circuit is drawn into the swash plate chamber 25 through the suction hole P, and then passes through the bolt insertion holes BH and the communication passages R4 until the refrigerant reaches the rear suction chamber 14*b* in the rear housing member 14. Then, the refrigerant in the rear suction chamber 14*b*, which functions as the suction pressure zone, flows into each rear compression chamber 29*a* from the associated rear suction port 43*b* pressing open the corresponding flap valve 46*a* according to the difference between the pressure in the rear suction chamber 14*b* and the pressure in the rear compression chamber 29*a* (rear cylinder bore 29).

When a discharge stroke takes place in each rear cylinder bore 29, that is, when each double-headed piston 30 moves from the left side to the right side in FIG. 6, the refrigerant in the associated rear compression chamber 29*a* flows out from the corresponding rear discharge port 43*a* pressing open the associated discharge valve 44*a*, and is discharged into the rear discharge chamber 14*a*, which functions as the discharge pressure zone. The refrigerant discharged to the rear discharge chamber 14*a* flows through a communication passage, which is not shown, and flows to the external refrigerant circuit through the discharge hole.

The two refrigerant suction mechanisms of the compressor 10 according to the fourth embodiment include the flap valves 46*a* and the rotary valve 49. Thus, in the fourth embodiment also, the same operations as that of the first to third embodiments are obtained. That is, although the arrangement of the flap valves 46*a* and the rotary valve 49 in the compressor 10 of the fourth embodiment is reversed with respect to that of the first to third embodiments, the same operations are obtained.

Therefore, the fourth embodiment has the following advantages in addition to the advantages (1) and (2) of the first embodiment and the advantage (8) of the second embodiment.

(10) The supply passage 47 of the rotary valve 49 is the groove-like passage. Thus, compared to a case where a bore-like passage is formed by boring the rotary shaft 22, the manufacturing costs of the rotary shaft 22 are reduced.

(11) The refrigerant in the swash plate chamber 25 is supplied to the rotary valve 49 via the seal chamber 13*c* of the shaft sealing assembly 23. Thus, the shaft sealing assembly 23 is cooled by the refrigerant. This extends the life of the shaft sealing assembly 23, and prevents change in the property of the lubricant of the shaft sealing assembly 23.

A fifth embodiment of the present invention will now be described with reference to FIG. 7.

Like the compressor 10 according to the fourth embodiment, in the compressor 10 of the fifth embodiment, the mechanism for drawing in refrigerant to the front compression chambers 28*a* is configured by the rotary valve 49 and the mechanism for drawing in refrigerant to the rear compression chambers 29*a* is configured by the flap valves 46*a*. According to the fifth embodiment, the structure of the passage for supplying refrigerant to the front compression chambers 28*a* via the rotary valve 49 differs from that of the fourth embodiment.

Figure 7:
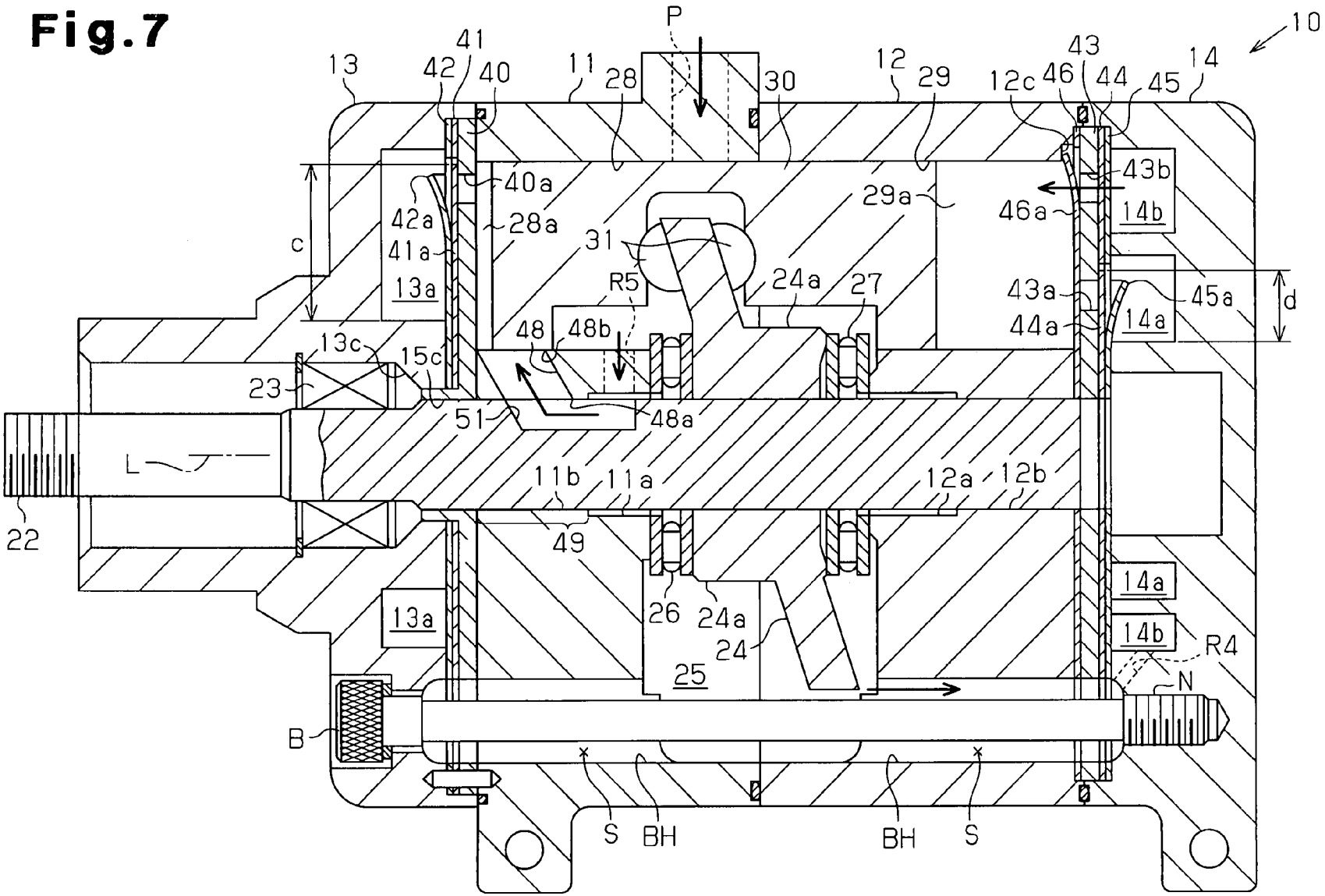
FIG. 7 is a cross-sectional view illustrating a double-headed piston type compressor according to a fifth embodiment of the present invention.

As shown in FIG. 7, a supply passage 51 is formed in the rotary shaft 22. The supply passage 51 of the fifth embodiment is a groove-like passage formed by machining a groove in the outer circumferential surface of the rotary shaft 22, which is a solid shaft. A communication passage R5 is formed in the front cylinder block 11 to connect the swash plate chamber 25 to the shaft hole 11*a*. The supply passage 51 is formed to connect the suction passages 48 (five in the fifth embodiment, only one of the suction passages 48 is shown in FIG. 7) in the front cylinder block 11 to the communication passage R5.

In the compressor 10 configured as described above, when a suction stroke takes place in each front cylinder bore 28, that is, when each double-headed piston 30 moves from the left side to the right side in FIG. 7, the supply passage 51 is connected to the inlet 48*a* of the associated suction passage 48, and the refrigerant in the swash plate chamber 25, which functions as the suction pressure zone, is drawn into the associated front compression chamber 28*a* via the rotary valve 49. That is, as shown by arrows in FIG. 7, the refrigerant in the external refrigerant circuit is drawn into the swash plate chamber 25 through the suction hole P, and then flows through the communication passage R5 and reaches the supply passage 51. The refrigerant in the supply passage 51 is drawn into the front compression chamber 28*a* through the associated suction passage 48 by the operation of the rotary valve 49.

When a discharge stroke takes place in each front cylinder bore 28, that is, when each double-headed piston 30 moves from the right side to the left side in FIG. 7, the refrigerant in the associated front compression chamber 28*a* flows out from the corresponding front discharge port 40*a* pressing open the associated front discharge valve 41*a*, and is discharged into the front discharge chamber 13*a*, which functions as the discharge pressure zone. The refrigerant discharged into the front discharge chamber 13*a* flows through a communication passage, which is not shown, and flows to the external refrigerant circuit through the discharge hole. The flow of refrigerant when a suction stroke or a discharge stroke takes place in each rear cylinder bore 29 is the same as that in the fourth embodiment. Since the flap valves 46*a* and the rotary valve 49 are employed as the refrigerant suction mechanisms in the compressor 10 according to the fifth embodiment, the same operations as those of the compressor 10 according to the fourth embodiment (first to third embodiments) are obtained. The fifth embodiment has the same advantages as the advantage (1) and (2) of the first embodiment, the advantage (8) of the second embodiment, and the advantage (10) of the fourth embodiment.

The above embodiments may be modified as follows.

In each of the embodiments, the structure of the passage of the rotary valves 35, 49 may be changed. For example, in a case where the rotary valves 35, 49 have the bore-like passage, the diameter and the length of the bore-like passage may be changed. In a case where the rotary valves 35, 49 have the groove-like passage, the depth and the length of the groove may be changed. Furthermore, for example, in the third embodiment shown in FIG. 5, the supply passage 22*b* of the rotary valve 35 may be configured by only the groove-like passage section 37.

In the second to fifth embodiments, the valve dimension of the discharge valves 16*a*, 20*a*, 41*a*, 44*a*, which are flap valves provided in the discharge chambers 13*a*, 14*a*, may be the same.

In each of the embodiments, in a case where the refrigerant suction mechanism is configured by the flap valves 18*a*, 46*a*, the arrangement of the discharge chambers 13*a*, 14*a* and the suction chambers 13*b*, 14*b* provided in the front housing member 13 or the rear housing member 14 may be changed.

In each of the embodiments, the arrangement of the suction hole P connected to the external refrigerant circuit may be changed. For example, the suction hole P may be formed in the rear housing member 14.

In each of the embodiments, a path for supplying refrigerant from the suction hole P, which is connected to the external refrigerant circuit, may be changed. For example, in each of the embodiments, the bolt insertion holes BH are used to supply refrigerant to the suction chambers 13*b*, 14*b*. However, a supply passage separate from the bolt insertion holes BH may be provided in the cylinder blocks 11, 12.

The above embodiments are embodied in the ten cylinder compressor 10, but the number of the cylinders may be changed.

Figure 3:
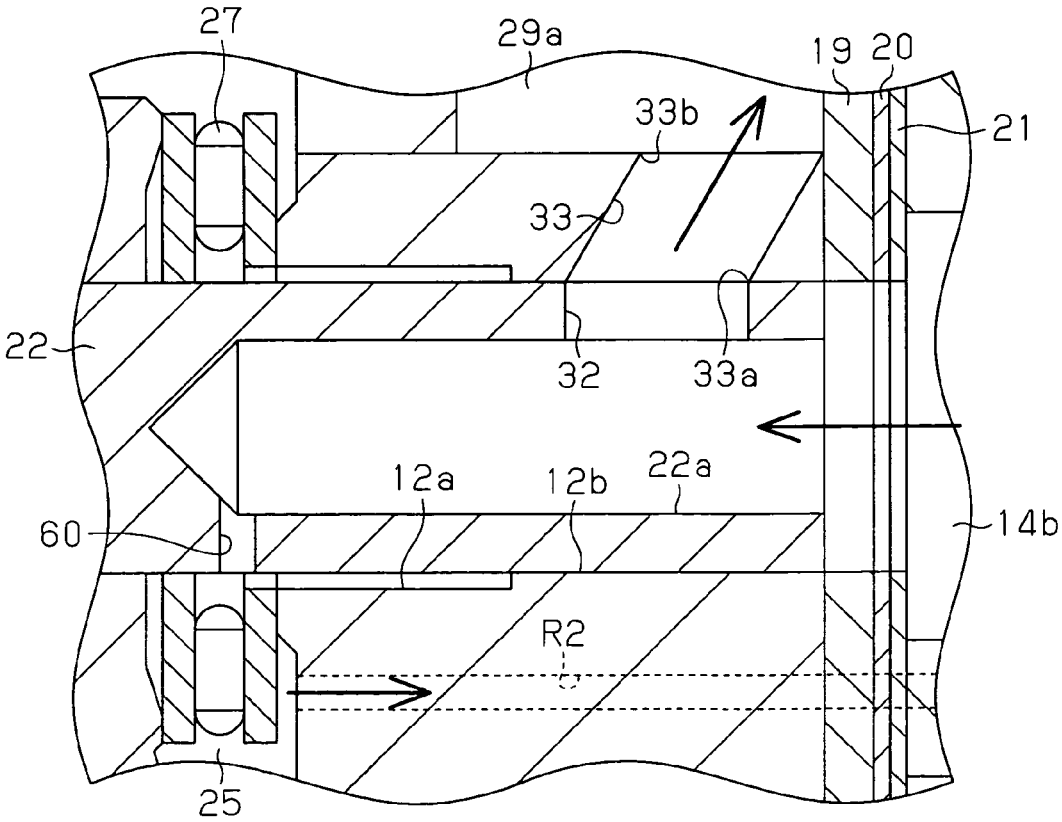
FIG. 3 is an enlarged cross-sectional view illustrating an important part of a double-headed piston type compressor according to a modified embodiment of the present invention.

As shown in FIG. 3, in the first embodiment, an oil supply passage 60, which is connected to the supply passage 22*a* of the rotary valve 35, may be formed in the rotary shaft 22. The supply passage 22*a* shown in FIG. 3 extends longer toward the front of the compressor 10 than the supply passage 22*a* shown in FIG. 1, and the oil supply passage 60 is formed at a position corresponding to the thrust bearing 27. The lubricant included in the refrigerant that passes through the supply passage 22*a* is separated from the refrigerant and adheres to the circumferential surface of the supply passage 22*a*, and then passes through the oil supply passage 60 as the rotary shaft 22 rotates. The lubricant in the oil supply passage 60 trickles down along the thrust bearing 27 and is supplied to the swash plate chamber 25. That is, the oil supply passage 60 functions as a return passage for returning the lubricant to the swash plate chamber 25. This improves the lubricity of sliding parts in the swash plate chamber 25. Furthermore, since the lubricant is returned to the swash plate chamber 25, the amount of lubricant contained in refrigerant (oil rate) in the external refrigerant circuit, in particular, in the refrigerant circuit connected to the outside of the compressor 10 is reduced, which improves the cooling performance. Also, reducing the amount of oil that flows to the outside of the compressor 10 reduces the amount of oil preliminarily sealed in the compressor 10 during manufacturing. The oil supply passage 60 may also be applied to the other embodiments.

In each of the embodiments, a residual refrigerant bypass groove may be formed in the outer surface of the rotary shaft 22 on which the rotary valve 35 or 49 is formed. The residual refrigerant bypass groove forms a passage that collects refrigerant remained in each compression chamber at the end of a discharge stroke, and supplies the collected refrigerant to the compression chamber at the end of a suction stroke. That is, the residual refrigerant bypass groove is formed to connect the compression chamber (cylinder bore) at the end of the discharge stroke to the compression chamber (cylinder bore) at the end of the suction stroke. Thus, when the compression chamber at the end of the discharge stroke is shifted to the suction stroke again, refrigerant remained in the compression chamber is suppressed from expanding again, and refrigerant is reliably drawn into the compression chamber.

The technical ideas obtainable from the above embodiments other than those disclosed in the claim section are described below with their advantages.

(1) The refrigerant compressed in the compression chambers in the front housing member is discharged to the discharge pressure zone by the discharge valves located between the compression chambers and the front housing member, and the refrigerant compressed in the compression chambers in the rear housing member is discharged to the discharge pressure zone by the discharge valves located between the compression chambers and the rear housing member, wherein the valve dimension of the discharge valves of the first compression chambers is greater than the valve dimension of the discharge valves of the second compression chambers.

The invention claimed is:

1. A double-headed piston type compressor comprising:

a front housing member;

a rear housing member;

a cylinder block located between the front housing member and the rear housing member, the cylinder block including a plurality of cylinder bores, and the front housing member, the rear housing member, and the cylinder block define a swash plate chamber;

a suction pressure zone;

double-headed pistons each of which is slidably inserted in one of the cylinder bores, wherein each double-headed piston defines a compression chamber close to the front housing member and a compression chamber close to the rear housing member, and one set of the compression chambers serves as first compression chambers and the other set of the compression chambers serves as second compression chambers;

a rotary shaft rotatably supported in the cylinder block;

a swash plate, which rotates with the rotary shaft in the swash plate chamber, the swash plate causes the double-headed pistons to reciprocate in the cylinder bores, and as a result, refrigerant is drawn into the compression chambers from the suction pressure zone and is compressed in and discharged from the compression chambers;

a mechanism for drawing in the refrigerant to the first compression chambers, the mechanism being configured by a rotary valve, which includes an introduction passage for introducing the refrigerant from the suction pressure zone to the first compression chambers, but the mechanism being not configured by suction valves, which selectively open and close in accordance with the difference between the pressure in the suction pressure zone and the pressure in the first compression chambers; and a mechanism for drawing in the refrigerant to the second compression chambers, the mechanism being configured by suction valves, which selectively open and close in accordance with the difference between the pressure in the suction pressure zone and the pressure in the second compression chambers, but the mechanism being not configured by a rotary valve, which includes an introduction passage for introducing the refrigerant from the suction pressure zone to the second compression chambers, and wherein a phase difference occurs between the time at which refrigerant is discharged from each of the first compression chambers and the time at which refrigerant is discharged from each of the second compression chambers.

2. The double-headed piston type compressor according to claim 1, wherein the compression chambers close to the front housing member are the first compression chambers, and wherein the compression chambers close to the rear housing member are the second compression chambers.

3. The double-headed piston type compressor according to claim 1, wherein the compression chambers close to the front housing member are the second compression chambers, and wherein the compression chambers close to the rear housing member are the first compression chambers.

4. The double-headed piston type compressor according to claim 1, wherein the introduction passage includes a groove-like passage formed in the outer circumference of the rotary shaft.

5. The double-headed piston type compressor according to claim 1, wherein the introduction passage includes a bore-like passage bored in the rotary shaft such that the introduction passage is open at an end of the rotary shaft.

6. The double-headed piston type compressor according to claim 1, wherein the refrigerant compressed in the first compression chambers is discharged to a first discharge pressure zone by a first set of discharge valves located between one of the front housing and the rear housing and refrigerant compressed in the second compression chamber is discharged to a second discharge pressure zone by a second set of discharge valves located between the other of the front housing and the rear housing, wherein the valve dimension of the first discharge valves of the first compression chambers is greater than the valve dimension of the second discharge valves of the second compression chambers.

* * * * *